US005221488A

United States Patent [19]

Amberg et al.

[11] Patent Number: 5,221,488

[45] Date of Patent: Jun. 22, 1993

[54] PROCESS FOR DOSING PASTE-FORM DETERGENTS

[75] Inventors: Guenter Amberg, Neuss; Heiner Brinkmann, Hilden; Uwe Trabitzsch, Ratingen; Rolf Ullrich, Moenchengladbach; Guntram Walther, Leichlingen, all of Fed. Rep. of Germany

[73] Assignee: Henkel Kommanditgesellschaft auf Aktien, Duesseldorf, Fed. Rep. of Germany

[21] Appl. No.: 651,344

[22] PCT Filed: Jul. 25, 1989

[86] PCT No.: PCT/EP89/00877

§ 371 Date: Feb. 1, 1991

§ 102(e) Date: Feb. 1, 1991

[87] PCT Pub. No.: WO90/01533

PCT Pub. Date: Feb. 22, 1990

[30] Foreign Application Priority Data

Aug. 1, 1988 [DE] Fed. Rep. of Germany ..... 3826110

[51] Int. Cl.[5] ..... D66L 1/12; C11D 17/08

[52] U.S. Cl. ..... 252/8.9; 8/137; 134/56 R; 134/93; 134/198; 252/87; 252/170; 252/174.21; 252/DIG. 1

[58] Field of Search ..... 252/8.9, 8.7, 170, 174.21, 252/DIG. 1, 89.1; 222/1; 34/93, 198

[56] References Cited

U.S. PATENT DOCUMENTS 4,889,644 12/1989 Amberg et al. ..... 252/DIG. 1

*Primary Examiner*—Ferris Lander

*Attorney, Agent, or Firm*—Ernest G. Szoke; Wayne C. Jaeschke; Real J. Grandmaison

[57] ABSTRACT

A unit consisting of a cartridge provided with a base plate displaceable under pressure is used for the program-controlled dosing of paste-form detergents. The orifice of the cartridge leads into the dispensing compartment of the washing machine, more particularly into the region of a spray jet or into a region of high turbulence of the inflowing water. The detergent paste consists of nonionic surfactants liquid at temperature below 10° C. or mixtures thereof and, suspended therein, builder salts and washing alkalis having a particle size in the range from 5 to 40 μm.

17 Claims, No Drawings

PROCESS FOR DOSING PASTE-FORM DETERGENTS

This invention relates to a process which is particularly suitable for use in institutional laundries and which is based on the development of a new paste-form detergent introduced into the washing process by means of a specially adapted dosing system.

Liquid to paste-form detergents are known in large numbers. They are generally adapted to domestic requirements, i.e. they should be sufficiently liquid so that they can be poured out and dosed without difficulty. Since, in addition, they should be stable in storage over a relatively wide temperature range, organic solvents and/or hydrotropic additives normally have to be used. However, these additives are inactive in the washing process, comparatively expensive and, in addition, take up packaging space and transport and storage capacity. The presence of volatile inflammable solvents is particularly troublesome and necessitates additional safety precautions. Accordingly, detergent concentrates of the type mentioned are of no use or of only very limited use for laundries.

Paste-form, substantially anhydrous detergents are also known, for example from U.S. Pat. Nos. 4,115,308 and 3,850,831. They also normally contain liquid additives inactive in the washing process, such as polyglycols or triethanolamine, for dispersing the finely divided builder salts and for establishing viscosity so that they may readily be squeezed out from a tube by hand pressure. In this form, they are unsuitable for use in washing machines equipped with standard dispensing compartments. This is because if the paste is dosed into these compartments, it is not dissolved and dispersed by the inflowing water, instead a gel surface layer is formed around the paste and prevents any further dissolution. The gel-like paste passes together with the inflowing water into the liquor drum where, on account of its high specific gravity, it collects almost completely in the vicinity of the outlet pipe where it remains virtually unchanged until the washing process is over. The detergent then passes substantially unused into the main drains with the rinsing water.

Another disadvantage which, hitherto, has prevented paste-form detergents from being used in institutional laundries are packaging and dosing problems. Tubes are unsuitable for such applications because they are only suitable for limited filling volumes and, hence, are labor-intensive and time-consuming in terms of handling. In addition, excessive residues generally remain on the walls of the tube and around the head of the tube. The removal of viscous pastes from typical storage containers by means of dosing spoons is also complicated and labor-intensive and, in addition, leads to the dispensing problems mentioned above.

Accordingly, powder-form detergents are mainly used in institutional laundries. Since the exact dosing of powderform detergents is problematical and labor-intensive, particularly in large automated laundries, they are generally stored and dosed in predissolved form as stock liquors, i.e. an aqueous concentrate is prepared and is delivered to the individual machines. However, the detergents typically used in laundries contain comparatively large amounts of washing alkalis which show only limited solubility in cold water and, in addition, lead to salting-out effects. They give rise to phase separation with the result that the organic components, particularly nonionic surfactants and soaps, settle out and cream. Accordingly, the stock liquors have to be diluted relatively heavily with water and, in addition, have to be intensively mixed and circulated continuously to prevent individual components from being deposited in the feed lines to the individual machines. Accordingly, processes of the type in question require considerable investment in large mixing vessels and the statics involved and in mixers and transport systems and also require a continuous supply of energy for heating and recirculating the stock liquors.

Accordingly, there is a considerable need for detergent compositions and adapted dosing systems by which the problems mentioned above are avoided and which satisfy the following requirements:

- high washing power
- elimination of the need for additives inactive in the washing process which are merely used to condition the detergent
- minimal packaging, transport and storage space
- problem-free processability, even at low temperatures or of supercooled pastes
- simple connection to the dosing system with no pouring losses or residues in the pack
- a dosing system which can be simply and compactly installed
- suitability of the system for process-dependent control of the dosing time and dosing balance
- considerable variability in the choice of the quantity and concentration of detergent
- immunity to disturbance by gel formation and deposition in the liquor container
- minimal energy demand.

These problems are solved by the present invention.

The invention relates to a process for the dosing of detergents which is characterized by the use of A) a paste-form, pseudoplastic, phosphate-reduced to phosphate-free detergent which is substantially free from water, organic solvents and hydrotropic compounds, consisting of a phase liquid at temperatures below 10° C., which is formed of nonionic surfactants selected from polyglycol ether compounds, and of a solid particulate phase dispersed therein and formed of washing alkalis, sequestering compounds and other detergent constituents and, optionally, anionic surfactants, B) a pressure-tight container for the paste-form detergent consisting of a hollow cylinder which is closed at one end by a plate displaceable axially of the cylinder in the container and which, at its other end, has an outlet opening and a releasable connecting element by which the container can be coupled to the unit (C), C) a dosing unit controlled in dependence upon the amount of water flowing in or upon the concentration of the wash liquor and consisting of a plunger acting on the displaceable closure plate of the container and of an outlet nozzle for the paste-form detergent connected to the outlet opening of the container through the releasable connecting element, the outlet nozzle which can be provided with a controllable shutoff element being arranged in the dispensing compartment of the washing machine in such a way that its orifice is situated in the vicinity of the spray jet or in the vicinity of high turbulence of the inflowing water.

The individual features of the inventions will now be described.

A) Detergent

The detergent consists of a paste which is substantially free from water and organic solvents. The expression "substantially free from water" is understood to mean a state in which the content of liquid water, i.e. water not in the form of water of hydration and water of constitution, is below 2% by weight, preferably below 1% by weight and more preferably below 0.5% by weight. Higher water contents are a disadvantage because they increase the viscosity of the detergent overproportionally and reduce stability. Organic solvents, including the low molecular weight and low-boiling alcohols and ether alcohols typically used in liquid concentrates, and hydrotropic compounds are also absent, apart from traces which may be introduced by individual active components.

The detergent consists of a liquid phase and of a finely divided phase dispersed therein.

The liquid phase consists essentially of nonionic surfactants melting at temperatures below 10° C. or mixtures thereof. It is best to use surfactants or mixtures of surfactants which have a setting point (solidification point) below 5° C. to avoid solidification of the paste at relatively low transport and storage temperatures. Examples of such surfactants are, for example, alkoxylated alcohols which may be linear or methyl-branched in the 2-position (oxo alcohols) and which contain from 9 to 16 carbon atoms and from 2 to 10 ethylene glycol ether groups (EO). Alkoxylates containing both EO groups and also propylene glycol ether groups (PO) are also suitable by virtue of their low setting point. Examples of suitable nonionic surfactants are: $C_{9-11}$ oxo alcohol containing 2 to 10 EO, such as $C_{9-11}$+3 EO, $C_{9-11}$+5 EO, $C_{9-11}$+7 EO, $C_{9-11}$+9 EO; $C_{11-13}$ oxo alcohol containing 2 to 8 EO, such as $C_{11-13}$ +2 EO, $C_{11-13}$ +5 EO, $C_{11-13}$ +6 EO, $C_{11-13}$ + 7 EO; $C_{12-15}$ oxo alcohol + 3–6 EO, such as $C_{12-15}$+3 EO, $C_{12-15}$+5 EO; isotridecanol containing 3 to 8 EO; linear fatty alcohols containing 10 to 14 carbon atoms in 2.5 to 5 EO; linear or branched $C_{9-14}$ alcohols containing 3 to 8 EO and 1 to 3 PO, such as $C_{9-11}$ oxo alcohol+$(EO)_4$ $(PO)_{1-2}$ $(EO)_4$ or $C_{11-13}$ oxo alcohol+$(EO)_{3-10}$ $(PO)_{1-5}$ containing statistically distributed alkoxyl groups; linear saturated and unsaturated $C_{12-18}$ fatty alcohols or $C_{9-15}$ oxo alcohols containing 1 to 3 PO and 4 to 8 EO, such as $C_{12-18}$ coconut oil+$(PO)_{1-2}$ $(EO)_{4-7}$, oleyl alcohol or a 1:1 mixture of cetyl-oleyl alcohol+$(PO)_{1-2}$ $(EO)_{5-7}$, $C_{11-15}$ oxo alcohol+$(PO)_{1-2}$ $(EO)_{4-6}$.

Ethoxylated alcohols of which the terminal hydroxyl groups are alkylated by lower alkyl groups are also suitable for the purposes of the invention by virtue of their low setting point and include, for example, a $C_{10-14}$ alcohol containing 3 to 10 EO groups and a terminal methoxy group. Other suitable nonionic surfactants are EO-PO-EO block polymers having a correspondingly low setting point and ethoxylated alkylphenols, such as nonylphenol containing 7 to 10 EO. However, the last of these surfactants may be precluded from use in individual fields on account of their reduced biodegradability. Accordingly, they are less preferred.

The content of the nonionic surfactants mentioned above in the pastes should be gauged in such a way that, on the one hand, they are still sufficiently flowable and pumpable under the effect of shear forces and, on the other hand, are so stiff or viscous at rest that no separation occurs, even after prolonged standing. Suitable pastes are those containing 15 to 35% by weight, preferably 18 to 30% by weight and more preferably 20 to 25% by weight of liquid nonionic surfactants having a low setting point (below 5° C.). Where surfactants having a higher setting point, for example in the range from 5° to 20° C., are used in admixture with particularly low-melting surfactants, the minimum content is somewhat higher, for example of the order of 18% by weight and preferably in the range from 22 to 24% by weight, the maximum content being at 35% by weight and preferably at 30% by weight.

In individual cases, a single nonionic surfactant may have the desired qualifications in regard to low setting point, favorable flow behavior, high detergency and low foaming. Surfactants such as these include, for example, oleyl alcohol or mixtures rich in oleyl alcohol which have been reacted first with 1 to 2 PO and then with 5 to 7 EO. However, particularly favorable properties are often obtained with mixtures of nonionic surfactants having different degrees of ethoxylation and, optionally, different C-chain lengths. Mixtures of nonionic surfactants having a low degree of ethoxylation and a low setting point, for example $C_{9-15}$ alcohols containing 2 to 5 EO, and those having a relatively high degree of ethoxylation and a relatively high setting point, for example $C_{11-15}$ alcohols containing 5 to 7 EO, are therefore particularly preferred. The ratio in which the two alcohol ethoxylates are mixed is determined both by the requirements which washing has to satisfy and also by the flow behavior of the washing paste and is generally in the range from 15:1 to 1:3 and preferably in the range from 8:1 to 1:1. Examples of corresponding mixtures are a mixture of 2 parts by weight $C_{9-11}$ oxo alcohol+2.5 EO and 1 part by weight $Cu_{11-13}$ oxo alcohol+7 EO, a mixture of 3 parts by weight of a $Cu_{11-14}$ oxo alcohol+3 EO and 2 parts by weight of a $C_{9-13}$ oxo alcohol+8 EO and a mixture of 7 parts by weight of a $C_{13}$ oxo alcohol+3 EO and 1 part by weight of the same alcohol+6 EO.

Finally, the flow properties of the pastes may be further modified by additions of polyethylene glycols of low molecular weight (for example in the range from 200 to 800) in quantities of, for example, up to 15% by weight. However, the contribution these additives—which are often included among the nonionic surfactants—make to detergent power is comparatively small. However, they can have a foam-inhibiting effect and, for this reason, are desirable. They are preferably used in quantities of up to 10% by weight and more preferably in quantities of from 0.5 to 8% by weight.

The polyglycols may also be completely or partly replaced by paraffin oils or liquid paraffin mixtures which, although making no contribution to detergency, nevertheless make the paste easier to process, particularly during grinding of the ingredients, and reduce foaming to a considerable extent, which is of particular advantage in the final rinse cycle. The content of paraffin oils or mixtures of paraffin oils is best no more than 8% by weight and preferably no more than 6% by weight. In addition, liquid long-chain ethers may be used for the same purpose in the same quantities. Examples of such ethers are the $C_{8-16}$ alkyl ethers of dicyclopentenol.

The detergent contains a solid phase which is homogeneously dispersed in the liquid phase and which contains the other washing-active constituents of the detergent and, optionally, auxiliaries. These other washing-active constituents of the detergent include above all washing alkalis and sequestering compounds. Anionic surfactants, particularly those from the class of sulfonate surfactants and the soaps, may also be present.

The preferred washing alkali is sodium metasilicate having the composition $Na_2O:SiO_2=1:0.8-1:1.3$ and preferably 1:1, which is used in anhydrous form. Besides the metasilicate, anhydrous soda is also suitable although, on account of absorption processes, it does require larger amounts of liquid phase and is therefore less preferred. The metasilicate content of the detergent may be between 35 and 70% by weight, preferably between 40 and 65% by weight and more preferably between 45 and 55% by weight while its soda content may be between 0 and 20% by weight and preferably between 0 and 10% by weight.

Suitable sequestering agents are those from the class of aminopolycarboxylic acids and polyphosphonic acids. The aminopolycarboxylic acids include nitrilotriacetic acid, ethylenediamine tetraacetic acid, diethylenetriamine pentaacetic acid and higher homologs thereof. Suitable polyphosphonic acids are 1-hydroxyethane-1,1-diphosphonic acid, aminotri-(methylenephosphonic acid), ethylenediamine tetra(methylenephosphonic acid) and higher homologs thereof, such as for example diethylenetriamine tetra-(methylenephosphonic acid). The polycarboxylic acids or polyphosphonic acids mentioned above are normally used in the form of their sodium or potassium salts. Sodium nitrilotriacetate is preferred, being used in quantities of up to 10% by weight and preferably in quantities of from 2 to 6% by weight.

Other suitable sequestering agents are polycarboxylic acids and hydroxypolycarboxylic acids in the form of their alkali metal salts, for example sodium citrate and sodium gluconate.

The sequestering agents preferably used include homopolymeric and/or copolymeric carboxylic acids and their sodium or potassium salts, the sodium salts being preferred. Suitable homopolymers are polyacrylic acid, polymethacrylic acid and polymaleic acid. Suitable copolymers are those of acrylic acid with methacrylic acid and copolymers of acrylic acid, methacrylic acid or maleic acid with vinyl ethers, such as vinyl methyl ether or vinyl ethyl ether; with vinyl esters, such as vinyl acetate or vinyl propionate, acrylamide, methacrylamide; and with ethylene, propylene or styrene. Copolymeric acids in which one of the components has no acid function are used in quantities of no more than 70 mol-% and preferably in quantities of less than 60 mol-% in the interests of adequate solubility in water. Copolymers of acrylic acid or methacrylic acid with maleic acid, as characterized for example in EP 25 551-B 1, have proved to be particularly suitable. These copolymers contain 50 to 90% by weight acrylic acid or methacrylic acid and 50 to 10% by weight maleic acid. Copolymers in which 60 to 85% by weight acrylic acid and 40 to 15% by weight maleic acid are present are particularly preferred.

Other suitable sequestering agents are polyacetal carboxylic acids of the type described, for example, in U.S. Pat. Nos. 4,144,226 and 4,146,495 which are obtained by polymerization of esters of glycolic acid, introduction of stable terminal groups and saponification to the sodium or potassium salts. Polymeric acids obtained by polymerization of acrolein and Canizzaro disproportionation of the polymer with strong alkalis are also suitable. They are essentially made up of acrylic acid units and vinyl alcohol units or acrolein units.

The molecular weight of the homopolymers or copolymers is generally in the range from 500 to 120,000 and preferably in the range from 1,500 to 100,000.

The proportion of polyacids or polymeric acids containing carboxyl groups present in the detergents is between 0 and 10% by weight, preferably between 1 and 7.5% by weight and more preferably between 2 and 5% by weight while the proportion of polyphosphonic acids is between 0 and 3% by weight, preferably between 0.05 and 1.5% by weight and more preferably between 0.1 and 1% by weight. They are used in anhydrous form.

The detergent pastes are preferably phosphate-free. Where the presence of phosphates is ecologically safe (as for example in the treatment of wastewater to eliminate phosphates), polymeric phosphates, such as sodium tripolyphosphate (STP), may even be present. The detergent paste may contain up to 20% by weight polymeric phosphates, in which case the proportion of other solids, for example the sodium silicate, is reduced accordingly. The STP content is preferably at most 15% by weight and, more preferably, at most 10% by weight.

Other suitable sequestering agents in the context of the invention are finely divided zeolites of the NaA type which have a calcium binding power in the range from 100 to 200 mg CaO/g (as determined in accordance with DE 24 12 837). Their particle size is normally in the range from 1 to 10 $\mu$m. They are used in dry form. The water present in bound form in the zeolites is not a problem in the present case. The zeolite content is from 0 to 20% by weight and preferably from 0 to 10% by weight.

Anionic surfactants are also suitable washing-active additives which may be incorporated in the detergent in solid, finely divided, substantially anhydrous form. Sulfonates and fatty acid soaps, preferably in the form of sodium salts, have proved to be particularly suitable. Suitable anionic surfactants of this type are alkyl benzenesulfonates having linear $C_{9-13}$ alkyl chains, particularly dodecyl benzenesulfonate, linear $C_{11-15}$ alkane sulfonates of the type obtainable by sulfochlorination or sulfoxidation of alkanes and subsequent saponification or neutralization, $\alpha$-sulfofatty acid salts and esters thereof derived from saturated $C_{12-18}$ fatty acids and lower alcohols, such as methanol, ethanol and propanol, and olefin sulfonates of the type formed, for example, by $SO_3$ sulfonation of terminal $C_{12-18}$ olefins and subsequent alkaline hydrolysis. Preferred surfactants are alkyl benzenesulfonates. Suitable soaps are those of saturated and/or unsaturated $C_{12-18}$ fatty acids, for example soaps obtained from coconut oil, palm kernel oil or tallow fatty acid. In the interests of low foaming in the use of the detergents, the percentage content of sulfonate surfactants should not exceed 4% by weight, based on the detergent, and is preferably from 0.5 to 2.5% by weight sodium dodecyl benzenesulfonate. An addition of sulfonate surfactant not only increases detergency, it also improves the stability of the pastes to sedimentation phenomena and facilitates dispersion of the paste in water. It has also surprisingly been found that the sulfonate surfactant is largely dispersed in the liquid phase and improves the solid/liquid balance in favor of the liquid phase. Accordingly, pastes containing sulfonate surfactants are capable of taking up relatively large quantities of solids and the proportion of nonionic surfactant can be reduced accordingly with no significant increase in viscosity.

An addition of soap of up to 1% by weight, preferably up to 0.5% by weight and more preferably from 0.1 to 0.3% by weight, based on the detergent, also increases the suspension stability of the paste. An addition such as this also reduces the tendency towards foaming and improves the detergency of the detergent. Larger percentage contents than 1 to 2% by weight can solidify the paste and should therefore be avoided.

Other constituents which may also largely be assigned to the solid phase are washing auxiliaries, including redeposition inhibitors, optical brighteners, foam inhibitors, bleaches and dyes. Where fragrances which are generally liquid are used, they pass into the liquid phase. By virtue of the small quantity in which they are used, however, they do not significantly affect the flow behavior of the pastes.

Suitable redeposition inhibitors are cellulose ethers, such as carboxymethyl cellulose, methyl cellulose, hydroxyalkyl celluloses, and mixed ethers, such as methyl hydroxyethyl cellulose, methyl hydroxypropyl cellulose and methyl carboxymethyl cellulose. Na carboxymethyl cellulose and mixtures thereof with methyl cellulose are preferably used. The percentage content of redeposition inhibitors is generally from 0.2 to 2% by weight and preferably from 0.5 to 1.5% by weight.

Suitable optical brighteners for fabrics of cellulose fibers (cotton) are, in particular, derivatives of diaminostilbene disulfonic acid and alkali metal salts thereof, for example salts of 4,4'-bis-(2-anilino-4-morpholino-1,3,5-triazin-6-ylamino)-stilbene-2,2'-disulfonic acid or compounds of similar structure which, instead of the morpholino group, contain a diethanolamino group, a methylamino group or a 2-methoxyethylamino group. In addition, brighteners of the substituted 4,4'-distyryl diphenyl type, for example the compound 4,4'-bis-(4-chloro-3-sulfostyryl)-diphenyl, may be present. Mixtures of brighteners may also be used. Brighteners of the 1,3-diaryl-2-pyrazoline type, for example the compound 1-(p-sulfamoylphenyl)-3-(p-chlorophenyl)-2-pyrazoline, and compounds of similar structure are suitable for polyamide fibers. The content of optical brighteners or mixtures of optical brighteners in the detergent is generally from 0.01 to 1% by weight and preferably from 0.05 to 0.5% by weight.

Suitable foam inhibitors are polysiloxane/silica mixtures known per se, the finely divided silica present therein preferably being silanized. The polysiloxanes may consist both of linear compounds of crosslinked polysiloxane resins and mixtures thereof. Other suitable foam inhibitors are paraffin hydrocarbons, including the paraffin oils already mentioned, and in addition microparaffins and paraffin waxes having melting points above 40° C. Other suitable foam inhibitors are saturated fatty acids or soaps containing 18 to 24 and preferably 20 to 22 carbon atoms, for example sodium behenate. The percentage content of additional foam inhibitors, i.e. beyond the paraffin oil, may be up to 2% by weight and is preferably up to 1% by weight and, in the case of soaps, correspondingly lower. In many cases, however, the tendency towards foaming can be reduced by a suitable choice of the nonionic surfactants, so that there is no need to use foam inhibitors.

Bleaches may be present as another constituent of the solid phase. Suitable bleaches are per compounds, such as sodium perborate monohydrate, caroates ($KHSO_5$) and organic peracids, such as perbenzoates or peroxyphthalates. These per compounds are stable in storage in the claimed detergents by virtue of the substantial absence of water. Known bleach activators may also be present, hydrolyzing with the per compounds on addition of water to form peracids. Examples of such bleach activators include tetraacetyl ethylenediamine and phthalic anhydride. Since, in institutional laundries, the bleach component is often separately added to the wash liquor and, in general, is only used where specifically required, there may even be no need for bleaches in the paste in cases such as these.

The constituents in the solid phase should be finely divided. A particulate phase of which the constituents have an average particle size of 5 to 40 μm, at most 10% of the particles having a particle size of at most 80 μm, has proved to be particularly advantageous. The mean particle size is preferably from 10 to 30 μm and more preferably from 10 to 20 μm, the maximum particle size being below 100 μm and more especially below 80 μm. The mean particle size is based on the volume distribution determined by known methods (for example Coulter Counter).

The viscosity of the pastes is in the range from 20 Pa.s to 1000 Pa.s (Pascal . sec.), as measured at 20° C. using a Brookfield viscosimeter (spindle No. 6, 10 r.p.m.). The preferred viscosity range is from 30 to 300 Pa.s and more preferably from 50 to 150 Pa.s. The pastes are thixotropic. At room temperature, their viscosity in the absence of shear forces is so high that they are unable under the sole effect of gravity to spill out from the storage container at all or in the necessary time or quantity for the intended application. They differ fundamentally in this regard from known, anhydrous, pourable liquid concentrates, for example those according to EP 30 096, U.S. Pat. Nos. 3,850,831 and 4,115,308, in which the proportion of liquid nonionic surfactants or organic solvents is considerably higher and, hence, the viscosity or kinematic viscosity considerably lower.

To produce the paste-form detergents, the liquid constituents, which are best heated to temperatures of 40° C. to 60° C., are premixed with the solids already present in powder form. The premix is then ground in a mill, for example a colloid mill, to the stated particle size for the solid phase and homogenized, excessive heating of the product being avoided by suitable cooling of the mill. If necessary, the homogenized paste is degassed in vacuo in a deaeration unit. Heat-sensitive constituents and constituents used for final viscosity adjustment, such as perfumes, dyes, organic per compounds, layer silicates and soaps, may then be added. The final paste may be directly packed in packaging containers.

B) Detergent container

The detergent container is cylindrical in shape and has an opening at either end. One of the two openings is closed by a plate arranged inside the container for displacement axially thereof. The displaceable plate is intended largely to seal off the wall of the container so that the paste is unable to escape there, i.e. the plate is best displaced with slight friction on the wall of the container. The plate may be flat or curved slightly inwards. To prevent the displaceable plate from tilting or canting, its edge is best bent outwards like a collar, i.e. the plate is in the form of a flat piston. An exact fit such as this also improves the sealing effect. In this embodiment, the displaceable plate may also serve as a closure for one end of the container during transport and storage of the container filled with the paste. It may be additionally secured by a releasable film or a film which yields under high pressure or by an artificial weak spot.

The container opening situated opposite the displaceable plate may encompass the entire cross-section of the container or may be narrowed in relation to that cross-section. In the first case, the opening is like the opening of an open cartridge and, in the second case, like the opening of a tube head for example. The container opening carries a releasable connecting element, preferably on its outside, by which it can be fastened or coupled to the dosing unit. This connecting element may consist, for example, of a screw thread (external thread), a bayonet closure, a groove or an encircling ring. During transport and storage of the filled container, the outlet opening is provided with a closure which engages in the connecting element and may consist, for example, of a screw cap or of a closure cap with a bayonet ring. However, an elastic, removable cap or a tearable film may also be used for this purpose.

Where the closure is in the form of a tube head, i.e. with a narrow outlet opening, its inner surface which faces in the direction of the displaceable plate should be designed in such a way that, in the empty state, only minimal quantities of paste, if any, remain behind. In accordance with the shape of the displaceable plate, therefore, the tube head may be internally flat or curved. In addition, the displaceable plate may be provided on its inside with a cylindrical or conical projection which, in the position of maximum displacement, projects into the outlet opening of the tube head and also ejects the residues of paste present therein. This projection may be hollow to the outside. The resulting recess may be simultaneously used to fix the plunger during the dosing process.

The container is made of a corrosion-resistant material, i.e. one which is not attacked by the detergent paste or by an aqueous detergent solution, such as plastic, metal or glass. Under the pressures applied, which are in the range from 1 to 10 kg/cm$^2$ and generally in the range from 1 to 5 kg/cm$^2$, it should remain largely dimensionally stable in the interests of a sufficiently accurate fit. Although the size of the container is not critical, its contents should best last for several hours to minimize packaging and labor costs. Accordingly, it should hold at least 0.2 liter and no more than 20 liters and preferably from 0.5 to 10 liters. Larger containers are relatively inconvenient to handle and expensive to manufacture.

C) Dosing unit

The dosing unit consists essentially of the following elements

- a releasable connecting element for the detergent container by which the detergent container can be coupled to the dosing unit,
- an outlet nozzle which projects into the dispensing compartment of the washing machine and of which the orifice is situated in the vicinity of the spray jet or in the vicinity of high turbulence of the inflowing water,
- a plunger which acts under pressure on the displaceable plate of the detergent container,
- optionally a shutoff element for the detergent paste in the region of the outlet nozzle,
- a controller which controls the advance of the plunger or the opening time of the shutoff element in the region of the outlet nozzle in dependence upon the inflow of water or the concentration of detergent in the wash liquor.

The connecting element is designed in such a way that it enables a firm connection sufficiently sealed off against the escape of detergent paste to be established with the coupled paste container. Screw joints and bayonet closures have proved to be particularly effective in this regard. Given a sufficiently accurate fit, there may even be no need for additional sealing elements or sealing rings. Squeezing rings or annular coupling elements which act on a correspondingly shaped groove or an encircling ring or an offset on the outlet nozzle of the paste container and which are operated automatically, for example pneumatically or hydraulically, may also be used with advantage.

The dosing unit comprises a plunger which acts under pressure on the displaceable plate of the paste container and advances it during removal of the paste. The advance may take place pneumatically, hydraulically or mechanically, for example by means of a rack or threaded spindle or by an eccentric. Providing no additional shutoff element is provided in the outlet nozzle, the advance takes place under control to ensure exact dosing of the paste. However, it is preferred to use an arrangement in which the plunger permanently applies a certain pressure to the displaceable plate and the paste is removed and dosed by a process-controlled shutoff element arranged between the connecting element and the outlet nozzle. In the most simple case, the plunger is operated hydraulically by the pressure of the water line. At the same time, an arrangement such as this is particularly immune to interference by varying or failing water pressure because any change in the water pressure and hence in the inflow of water is immediately compensated by a corresponding change in the paste pressure and in the volume of paste dispensed accordingly.

The outlet nozzle is intended to conduct the paste in the dispensing compartment into a region where the water applies intensive shear forces to the paste. As a result, the paste is divided into small particles which disperse and dissolve rapidly. The formation of a critical gel state is thus effectively prevented.

An undesirable gel state such as this is regularly formed when water acts on a paste having the stated composition in the absence of intense shear forces. In that case, the nonionic surfactants swell to form a viscous, gel-like mass which prevents the access of more water. The gel lumps formed do not dissolve quickly enough in the inflowing water and, on account of their comparatively high specific gravity, slide very quickly into the lowermost part of the liquor container or outlet pipe of the washing machine where they remain until the wash liquor is pumped off and are thus lost to the washing process.

These disadvantages are completely avoided by the described arrangement of the outlet nozzle and the described functional cycle. By conductivity measurements, it can be shown that the dispersing and dissolving process is over in seconds. This is essential if the dosing process is also to be controlled through the conductivity of the wash liquor. This of particular advantage when the water pressure is subject to considerable variations and when the concentration of the wash liquor is to be individually and automatically adapted to the degree of soiling of the laundry and, hence, to the soil load of the liquor. Control in dependence upon the degree of soiling of the laundry provides for particularly efficient utilization of the detergent and involves less pollution of the wastewater.

The outlet nozzle best has a narrow orifice with an internal diameter of from 0.5 to 10 mm and preferably from 1 to 6 mm.

A shutoff element, for example a shutoff cock or a valve, may be installed at a suitable point between the connecting element and the orifice of the outlet nozzle. The shutoff element may be opened and closed pneumatically, hydraulically or by servomotor. A shutoff element of the type in question is compulsory when, as described above, the plunger is under constant pressure and is not moved under control. In this preferred arrangement, the opening and closing of the shutoff element is process-controlled in dependence upon the inflow of water or, more preferably, in dependence upon the conductivity of the wash liquor. The second of these two alternatives provides for particularly exact adaptation to the soil load of the liquor and, optionally, for the redosing of detergent paste.

The dosing process is relatively easy to control. In the most simple case, it may be controlled by the automatic dispenser installed in the washing machine. It has proved to be best to control the inflow of water and the addition of detergent paste so that, at first, only a small proportion of the total water is introduced, after which the paste is introduced in the manner described and then flushed by the water into the washing process for a certain time. Where dosing is based on conductivity, it is best on account of the slight delay in the dissolving process to terminate addition of the paste at an earlier stage. The final concentration of the liquor and the corresponding conductivity of the liquor are then established a few seconds later and at most thirty seconds later. However, good results adapted to the particular requirements may also be obtained by a simple time switch.

The empty containers may be repeatedly refilled and reused or, given correspondingly low material costs, may even be discarded as non-reuseable packs.

The concentration of the wash liquor is in the range from 0.5 to 10 g/l and depends on the degree of soiling of the laundry, i.e. the in-use concentration for lightly soiled laundry is generally from 0.5 to 5 g/l and, for heavily soiled laundry, in the range from 5 to 10 g/l. In special cases, for example for heavily soiled working apparel, the concentration may be even higher, amounting for example to 12 g/l. In general, it is between 2 and 8 g/l. The liquor ratio (kg laundry to liter wash liquor) is generally from 1:2 to 1:10 and preferably from 1:4 to 1:6. Softened water (water treated by the Permutit process) is normally used for the wash liquor, softened water generally also being used for the final rinse and at least for the first final rinse. Basically, the washing process in the machine does not differ significantly from conventional processes except for the fact that, as mentioned above, the detergent can be automatically redosed in the event of increased demand through heavy soiling.

EXAMPLES

1. The detergent mixture (200 kg) contained the following anhydrous constituents (in % by weight):

| | |
|---|---|
| 24.0% | nonionic surfactant |
| 2.0% | Na dodecyl benzenesulfonate |
| 8.5% | Na nitrilotriacetate |
| 55.0% | Na metasilicate (1:1) |
| 8.5% | pentasodium triphosphate |
| 1.5% | cellulose ether |
| 0.5% | optical brightener |

The nonionic surfactant used was a mixture of saturated $C_{12-14}$ fatty alcohol+3 EO and $C_{12-14}$ fatty alcohol+5 EO in a ratio by weight of 1:1 having a solidification point (setting point) of 5° C.

The mixture was ground for 30 minutes in a mill (SZEGO-1 colloid mill). The ground product (exit temperature 45° C.) had a mean particle size of 18.6 μm and a viscosity of 50 Pa.s at 20° C. (Brookfield 6/10). 0.1% of a dye was added in a cooled paste mixing vessel with a wall stripper. The end product was a storable, pumpable paste having a specific gravity of 1.7 g/ml. A wash liquor prepared with this paste was low-foaming and showed high detergent power.

The paste was packed in cylindrical plastic cartridges (wall thickness 2 mm) with an external diameter of 10 cm, an overall length of 32 cm and a holding capacity of 2.2 liters. The flat, displaceable base plate had an encircling, collar-like rim 12 mm in height (as measured from the flat surface). Bayonet-like connecting elements were arranged around the outer circumference of the cartridge at its open end to fasten the cartridge with its opening face down to the connecting nozzle of the dosing unit. A seal was established between the connecting nozzle and the cartridge by means of an elastic sealing ring. The nozzle opened into a connecting pipe in which a shutoff cock was rotatably arranged. Beyond the shutoff cock, the connecting pipe terminated in a nozzle with an internal diameter of 2 mm. The orifice of this nozzle was directed straight onto the upper edge of the spray jet of water so that the issuing paste was entrained and dispersed by the water jet. The shutoff cock was connected to an electrically driven servomotor controlled by an automatic controller via a conductivity sensor arranged in the washing drum. The servomotor was controlled in such a way that approximately 10% of the total water required was initially fed in without any paste added. This water was simultaneously used to remove slight incrustations occasionally formed at the nozzle orifice after prolonged use under the effect of moisture. The paste was then added until the pre-programmed conductivity value was reached, after which more water was added to reach the necessary liquid level.

The necessary pressure was applied to the displaceable base plate by means of a hydraulically operated plunger. The pressure corresponded to the line pressure of the feed water and amounted to 1.5 kg/cm$^2$. It was only switched off during relatively long rest periods of the washing machine.

2. Example 1 was repeated using 57% by weight metasilicate and 22% by weight of a nonionic surfactant mixture of 2 parts by weight $C_{9-11}$ oxo alcohol+5 EO and 1 part by weight $C_{12-13}$ oxo alcohol+6 EO. The mean particle size of the ground material was 16.5 μm and the viscosity at 20° C. 54 Pa.s (Brookfield 16/20). This mixture was also storable, pumpable and dosable and, after dilution with water, formed low-foaming solutions having comparable properties.
3. Example 1 was repeated, 0.2% by Weight of the nonionic surfactant being replaced by the same quantity of a sodium tallow soap. The viscosity of the paste increased to 68 Pa.s. The aqueous solutions were particularly low-foaming.
4. A paste of the following composition (in % by weight) was prepared:

| | |
|---|---|
| 17.5% | $C_{13}$ oxo alcohol + 3 EO |
| 2.5% | $C_{13}$ oxo alcohol + 6 EO |
| 2.0% | Na dodecyl benzenesulfonate |

-continued

| | |
|---|---|
| 8.0% | polyethylene glycol (MW 400) |
| 7.5% | acrylic acid/maleic acid 3:1 copolymer (MW 70,000) in the form of the sodium salt |
| 2.5% | ethylenediamine tetra-(methylenephosphonate), $Na_6$ salt |
| 5.0% | Na nitrilotriacetate |
| 52.5% | Na metasilicate |
| 2.0% | cellulose ether |
| 0.3% | optical brightener |
| 0.2% | Na tallow soap |

The abbreviation MW stands for molecular weight. The constituents were processed to a homogeneous, stable paste in the same way as in Example 1. The mean particle size was 17.0 μm with none of the particles larger than 40 μm in size. The viscosity at 20° C. was 76 Pa.s (Brookfield 6/10). The paste corresponded in its performance properties to the detergent of Example 1 with even less foaming, particularly in the final rinse.

5. The polyethylene glycol ether in Example 4 was replaced by a 1:1 mixture of paraffin oil and a lauryl ether of dicyclopentenol. Compared with Example 4, approximately 20% less energy was required for grinding the paste. The viscosity was 74 Pa.s. In addition, the tendency of the paste to foam after dilution to the in-use concentration was even less than in Example 4.

6. The mixture contained the following liquid constituents (in % by weight): 22% oleyl alcohol/cetyl alcohol (1:1)+1.5 PO+6 EO 6% polyethylene glycol 400.

The composition of the solids, including Na dodecyl benzenesulfonate, was the same as in Example 4. The paste ground to a mean particle size of 18.2 μm and having a viscosity of 82 Pa.s was storable and pumpable. Its tendency to foam in the in-use concentration was minimal. In addition, the detergent was distinguished by improved removal in the final rinse.

We claim:

1. A process for dosing detergents, consisting of

A) preparing a paste-form, pseudoplastic, phosphate-reduced to phosphate-free detergent composition which is substantially free from water, organic solvents and hydrotropes, said composition comprising a liquid phase and a finely-divided solid phase, said liquid phase consisting essentially of from about 15 to about 35% by weight, based on the weight of said composition, of a nonionic surfactant having a melting point below about 10° C., said solid phase consisting essentially of washing alkalis and sequestering compounds homogeneously dispersed in said liquid phase, B) packaging said detergent composition of a pressure-tight container comprising a hollow cylinder having an opening at each end, one of the end openings being closed by a displaceable closure plate arranged inside said cylinder and which is displaceable axially of the cylinder, the other end having an outlet opening being provided with a closure and a releasable connecting element by which said container can be coupled to a dosing unit (C), and C) dosing said detergent composition with a dosing unit having an outlet nozzle connected to the outlet opening of the detergent composition container, wherein said outlet nozzle projects into the dispensing compartment of a washing machine and whose orifice is situated in the vicinity of the inflowing water of the washing machine, said dosing unit having a plunger adapted for acting under pressure on the displaceable closure plate of the detergent composition container to dispense the detergent composition therefrom directly into said dispensing compartment of said washing machine whereby said detergent composition is dispersed and dissolved by said inflowing water to such an extent that the formation of a gel phase is avoided.

2. A process as in claim 1 including controlling said dosing unit in dependence upon the amount of water flowing in or upon the conductivity of the wash liquor in the washing machine.

3. A process as in claim 1 including providing said outlet nozzle with a controllable shutoff element.

4. A process as in claim 1 wherein said displaceable closure plate is in the form of a flat plunger, and said releasable connecting element is in the form of a screwthread, a bayonet closure, a groove, or an encircling ring.

5. A process as in claim 1 wherein said outlet opening of said container is in the form of a tube head, and said displaceable closure plate is provided on its inside surface with a cylindrical or conical projection which in the position of maximum displacement of said plate projects into the outlet opening of said container.

6. A process as in claim 1 including adapting said plunger of said dosing unit to apply a constant pressure to the displaceable closure plate of said container, and dosing said detergent composition into a washing machine by means of a controllable shutoff element arranged between said releasable connecting element and the outlet nozzle of said dosing unit.

7. A process as in claim 6 wherein said shutoff element is controlled in dependence upon the electrical conductivity of the wash liquor.

8. A process as in claim 1 wherein said detergent composition contains from about from about 18 to about 30% by weight of said nonionic surfactant or a mixture thereof.

9. A process as in claim 1 wherein said detergent composition contains up to about 4% by weight of an anionic surfactant selected from a $C_{10-13}$ alkylbenzenesulfonate, $C_{11-15}$ alkane sulfonate, $C_{12-18}$ α-olefin sulfonate, α-sulfofatty acid, and up to about 1% by weight of a $C_{12-18}$ soap.

10. A process as in claim 1 wherein said detergent composition contains from about 35 to about 70% by weight of sodium metasilicate.

11. A process as in claim 1 wherein said finely-divided solid phase has an average particle size of between about 5 and about 40 μm, and no more than about 10% of the particles are larger in size than about 80 μm.

12. A process as in claim 1 wherein said detergent composition has a viscosity of from about 20 Pa.s to about 1,000 Pa.s as measured at 20° C. using a Brookfield viscosimeter spindle no. 6 at 10 r.p.m.

13. A process as in claim 1 wherein said nonionic surfactant comprises an alkoxylated alcohol containing from 9 to 16 carbon atoms and from about 2 to about 10 ethylene oxide groups.

14. A process as in claim 13 wherein said alkoxylated alcohol contains from about 1 to about 5 propylene oxide groups.

15. A process as in claim 1 wherein said detergent composition contains up to about 15% by weight of a polyethylene glycol having a molecular weight of from about 200 to about 800.

16. A process as in claim 1 wherein said detergent composition contains up to about 8% by weight of a paraffin oil.

17. A process as in claim 1 wherein said sequestering compounds are selected from polycarboxylic acids, hydroxypolycarboxylic acids, aminopolycarboxylic acids, and polyphosphonic acids, and salts thereof, and are present in an amount of up to about 10% by weight, based on the weight of said detergent composition.

* * * * *